US005261300A

United States Patent [19]

Willett

[11] Patent Number: 5,261,300

[45] Date of Patent: Nov. 16, 1993

[54] WRENCH FOR INSTALLING AN ELECTRICAL CONNECTOR

[75] Inventor: Norman F. Willett, Colonial Beach, Va.

[73] Assignee: The United states of America as represented by the Secretary of the Navy, Washington, D.C.

[21] Appl. No.: 966,478

[22] Filed: Oct. 26, 1992

[51] Int. Cl.[5] ..... B25B 13/28

[52] U.S. Cl. ..... 81/98; 81/185.1; 81/177.1; 81/489

[58] Field of Search ..... 81/52, 53.1, 53.11, 81/53.12, 53.2, 92, 94, 98, 99, 177.1, 185.1, 489, 111; 29/747

[56] References Cited

U.S. PATENT DOCUMENTS

| | | | |
|---|---|---|---|
| H226 | 3/1987 | Willett | 81/94 |
| 2,346,364 | 4/1944 | Dowe | 81/177.1 X |
| 4,052,917 | 10/1977 | Gee | 81/185.1 X |
| 4,068,374 | 1/1978 | Coller | 29/747 |
| 4,414,736 | 11/1983 | Fieberg et al. | 29/747 |
| 4,485,702 | 12/1984 | Swan et al. | 81/98 |
| 5,146,813 | 9/1992 | Stanfill | 81/52 X |

*Primary Examiner*—James G. Smith

*Attorney, Agent, or Firm*—John D. Lewis; Jacob Shuster

[57] ABSTRACT

A wrench for installing or removing an electrical connector having a collar is provided. The wrench comprises two handles, an elongated sleeve, a shaft, a cam, and a grip. One end of the elongated sleeve slidably attaches to a hub of the grip while the other end slidably attaches to the first handle. The grip further comprises a semicircular-shaped claw which engages the collar of the electrical connector. The shaft is rotatably disposed within the interior of the sleeve. One end of the shaft is eccentrically connected to the cam and the other end is connected to the second handle. The second handle is positioned within an aperture of the first handle. During operation of the wrench, the user grasps both handles and maneuvers the wrench between a series of cables on one side of an electric terminal assembly having a plurality of interconnected cables until the grip is positioned over the collar of a connector of a selected electrical cable. The second handle is then rotated for the purpose of gripping the collar between the claw and the cam. The wrench is then selectively moved in either an axial or rotational direction for the purpose of either installing or removing the associated connector end of the interconnected cable.

1 Claim, 6 Drawing Sheets

WRENCH FOR INSTALLING AN ELECTRICAL CONNECTOR

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to a wrench and more specifically to a remotely-controlled wrench having a claw and a rotating cam.

BACKGROUND OF THE INVENTION

Hand-service tools for effecting assembly and disassembly of components have a wide variety of shapes, sizes and uses. For example, U.S. Pat. No. 4,068,374 by Coler discloses a tool having a double handle and a wedge-clamping arrangement for effecting either removal of a housing from or installation of a housing to a pair of electric contact members of a circuit board The tool includes a forwardly-disposed wedge for initially-separating the pair of contact members. A pair of pivotally and resiliently-mounted clamping elements are provided such that the wedge is interposed therebetween. One handle supports the wedge and the pair of clamping elements while the other handle is pivotally mounted and has a camshaped end for controlling the opening and closing of the clamping elements. When the tool is placed over the housing, the wedge separates the contact members, and the other handle is then actuated to grip and remove the housing in an axial direction without causing abrasive injury to the surfaces of the contact member Conversely, the tool can also assemble a housing onto a pair of contact members.

In another example, U.S. Pat. No. 4,414,736 by Fieburg et al. concerns a manual tool for selectively inserting or removing electric leads from a multi-lead connector plug. The tool comprises a hand-grippable tool body which has a finger-actuatable spring-biased slider. The outer end of the slider includes a movable, finger-like jaw, the transverse section of which is in the shape of a semicircle. An opposed jaw also of semicircle configuration affixes to the tool body. The two jaws are used to grip an electric-insulated lead. One or more leads are then readily installed in or removed from their associated pin connection to an elastomeric plug by virtue of the elongated extent of the movable jaw combined with the maneuverability of the tool in close or immediate proximity to the plug.

Yet another example of the prior art is U.S. S.I. Reg. No. H226 by Willett, which discloses a manually-operable and remotely-controlled tool for selectively removing or installing connector ends of a clustered arrangement of interconnected cables of an electric terminal assembly. The tool is generally made up of a hub and opposed jaws. One end of an elongated sleeve is affixed to the hub while the other end is connected to a handle. The shaft is rotatably disposed in the sleeve with one end of the shaft affixed to a cam and the other end to a second handle that is freely disposed in an aperture of the first handle. During tool use, the user grasps both handles and maneuvers the hub and jaw among a clustered group of cables on one side of an electric terminal assembly having a plurality of interconnected cables.

The user then positions the jaws of the tool over a selected cable from the group. Next, the tool is moved along the path of the cable until the jaws are over the connector end of the selected cable. The user then rotates the second handle to secure the socket end between the jaws and the cam. The tool is moved in an axial or a rotational direction to install or remove the selected socket ends of the interconnected cable.

Despite the multitude of tools available among the prior art, advancing technology, particularly in the electric and electronic industry, has created new problems that render prior servicing tools ineffective. For example, in the area of electric terminal assemblies for interfacing and interconnecting various components of one or more networks, a series of connections of different sizes is frequently required. Because limited space is available, this series of different-sized connections is normally arranged in a close-clustered relationship. Further, conditions of terminal use require a positive snap-lock connection for maintaining electrical contact. This clustered arrangement of the connectors together with their snap-lock design renders difficulty during both installation and removal of these connectors. Further, only the prior art of Willett recognizes the importance of an elongated, unitized tool for remote axial or rotatable control and for selective access into a clustered arrangement of interconnected, different-size cables. The wrench disclosed in Willett, however, has welded construction which hinders disassembly and interchangeability of parts. Further, the elliptical shape of the opening between the opposing jaws of the wrench in Willett prevents engaging an electrical connector from the side of the connector. Instead, the Willett tool requires that the wrench be placed over the cable and then moved forward over the electrical connector. However, the design of many connectors, having enlarged butt ends, precludes sliding the wrench onto the connector from the cable attachment end. As a result, the Willett tool is unusable with this type of connector. Given these increasingly complex multiple and different-sized cable terminal interconnections, the limited access to these connections, and the snap-lock design, an improved elongated and remotely-operated wrench is needed to service these cable interconnections.

SUMMARY OF THE INVENTION

Accordingly, an object of the invention is to provide an improved, manually operable elongated wrench of unitized and lightweight construction that permits use by one with minimal skill in servicing socket-type connections of a series of clustered and interconnected cables of an electric terminal.

Another object of the present invention is to provide an improved, elongated wrench of unitized and lightweight construction having a special gripping end which can be easily disassembled and interchanged to handle a wide range of different-size socket connections.

Yet another object of the present invention is to provide an improved, elongated wrench having a gripping end which easily maneuvers about a cluster of tightly-spaced electrical socket connectors.

A further object of the invention is to provide a wrench which may grip an electrical connector by sliding directly onto the connector from the side.

Still another object of the present invention is to provide an improved, elongated wrench of simple construction that normally requires neither adjustment nor repair despite repeated use.

The foregoing and additional objects are attained by providing a wrench for installing or removing an electrical connector having a collar. The wrench comprises a grip, an elongated sleeve, two handles, a shaft, and a cam. The grip comprises a hub and a claw, with the claw having a semicircular shape for engaging the collar of the electrical connector. One end of the sleeve attaches to the hub of the grip while the other end attaches to the first handle. The first handle has an aperture in direct open communication with the interior of the sleeve. The shaft is rotatably disposed within the interior of the sleeve. One end of the shaft extends beyond the outer end of the hub and connects to the cam, which is accordingly positioned to rotate near the hub of the grip. The other end of the shaft connects to the second handle. The second handle rotates the shaft in either direction about its axis.

In the preferred embodiment, the elongated sleeve has a circular band around each end to prevent the translation of the grip and of the first handle over the sleeve beyond a predetermined point. The elongated sleeve also has a key on the outside of each end to secure the grip on one end and the first handle on the other after ,they slide into attachment over the sleeve. Correspondingly, the grip and the first handle both have a circular opening with a keyway for slidably attaching to the sleeve.

Also in the preferred embodiment, the claw of the grip has a plurality of grooves along its gripping surface while the cam has a flat surface on the end opposite its end of contact with the electrical connector. A second flat surface on the handle end of the shaft enables a locking screw, connected to the second handle, to secure the shaft and prevent rotation between the shaft and handle. Preferably, the first handle has an 0-shaped configuration while the second handle has a block-like shape. For sturdy, lightweight construction, the components of the present invention are made of aluminum.

During operation of the wrench, a user grips the first and second handles in pistol-like fashion and maneuvers the tool between a series of interconnected and clustered cables usually of different cross-sectional sizes until the intended cable to be serviced is aligned with the grip of the wrench. The user then maneuvers the wrench until the claw surrounds the collar of the selected connector. The second handle is then rotated relative to the first handle until the cam engages a portion of the connector end. At the same time, the claw engages portions of the selected connector end so that the connector is positively gripped between the cam and the claw. After this positive grip, the user further maneuvers the wrench to rotate or translate the connector axially and remove it from its connection. After disconnection of the socket end, the portable wrench can be remotely and controllably operated in reverse fashion for assembling the connector to its associated plug.

BRIEF DESCRIPTION OF THE DRAWINGS

Other objects and advantages of the invention become more apparent hereinafter when the detailed description of the invention is taken into account with the accompanying drawings wherein.

DETAILED DESCRIPTION OF THE INVENTION

Figure 1:
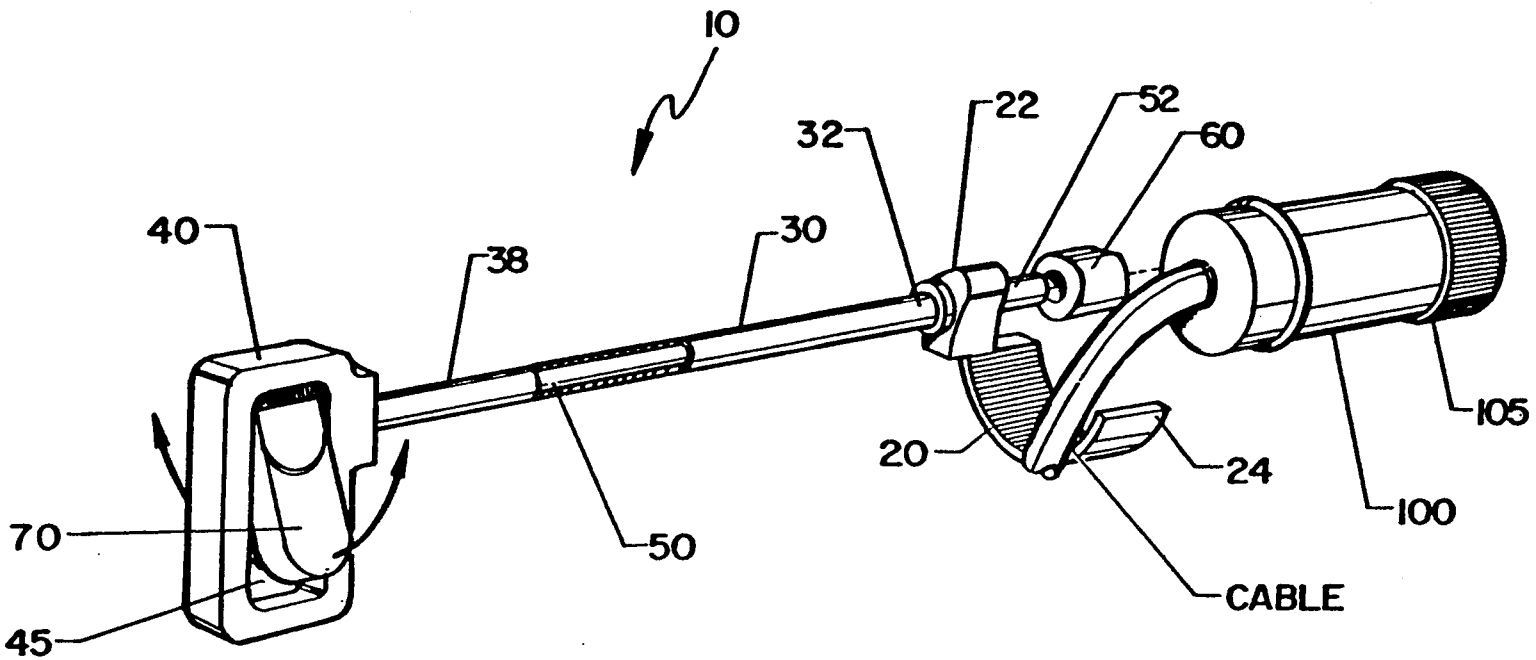
FIG. 1 is a perspective view of a wrench for installing or removing an electrical connector.
Figure 2:
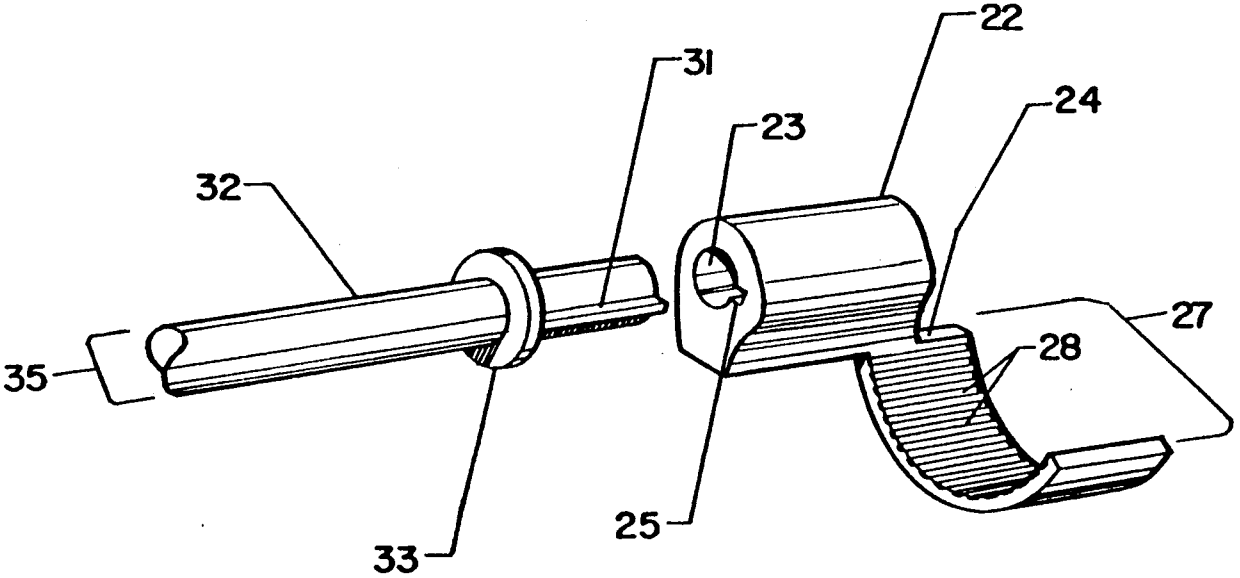
FIG. 2 is a perspective view of a grip for the wrench of the present invention before sliding attachment with an elongated sleeve.

Referring now to FIG. 1, a wrench 10 is shown for removing or installing an electrical connector 100 with a collar 105. The wrench comprises a grip 20, an elongated sleeve 30, a first handle 40, a shaft 50, a cam 60, and a second handle 70. For sturdy, lightweight construction, the components of the wrench 10 are made of aluminum. The grip 20 comprises a hub 22 and a claw 24. As shown in FIG. 2, the claw 24 has a semicircular shape with an opening 27 for engaging the collar of an electrical connector. The gripping surface of the claw has a plurality of grooves 28 to increase the coefficient of friction along the surface and, accordingly, to improve the claw's gripping ability.

Figure 3:
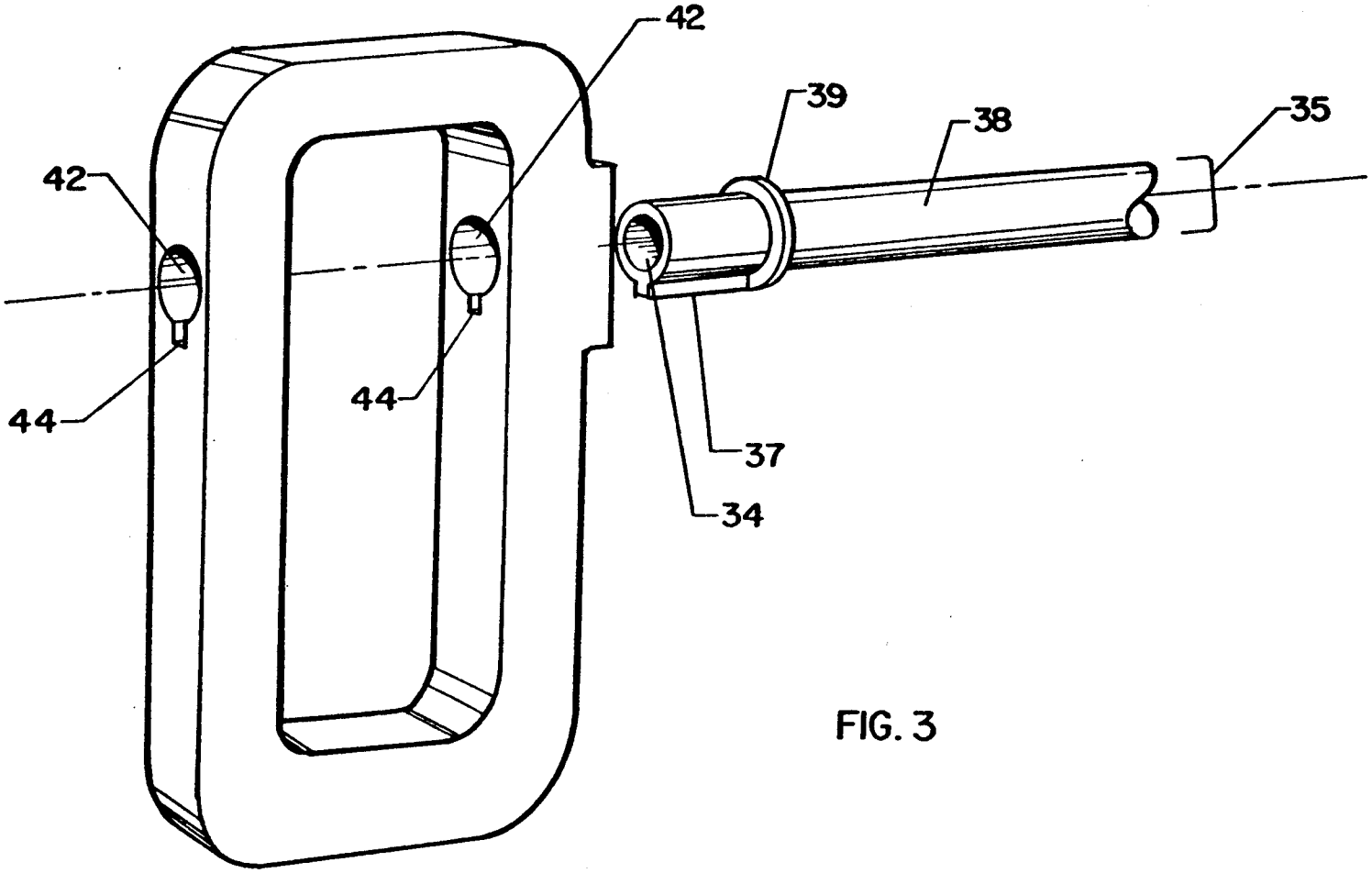
FIG. 3 is a perspective view of a first handle for the wrench of the present invention before sliding attachment with the elongated sleeve.

As illustrated in FIG. 1, the elongated sleeve 30 connects to the hub 22 of the grip on its first end 32 and to the first handle 40 on its second end 38. FIGS. 2 and 3 further detail these attachments. Referring to FIG. 2, the grip has a circular hole 23 with a keyway 25. The hole 23 and keyway 25 match the diameter 35 and a first key 31 located at the first end 32 of the elongated sleeve. The first key 31 secures the grip and hinders rotation of the grip about the axis of the sleeve. The elongated sleeve also has a first circular band 33 which prevents translation of the grip over the sleeve beyond a predetermined point, this point corresponding with the location of the first circular band 33.

As seen in FIG. 3, the elongated sleeve has an interior region 34 and a second key 37 on its second end 38. The second key 37 and the diameter 35 of the sleeve match a bore 42 and a keyway 44 of the first handle. The second key 37 secures the first handle and hinders rotation of the first handle about the axis of the elongated sleeve. Likewise, the elongated sleeve has a second circular band 39 which prevents translation of the first handle over the sleeve beyond a predetermined point, this point corresponding with the location of the second circular band.

Figure 4:
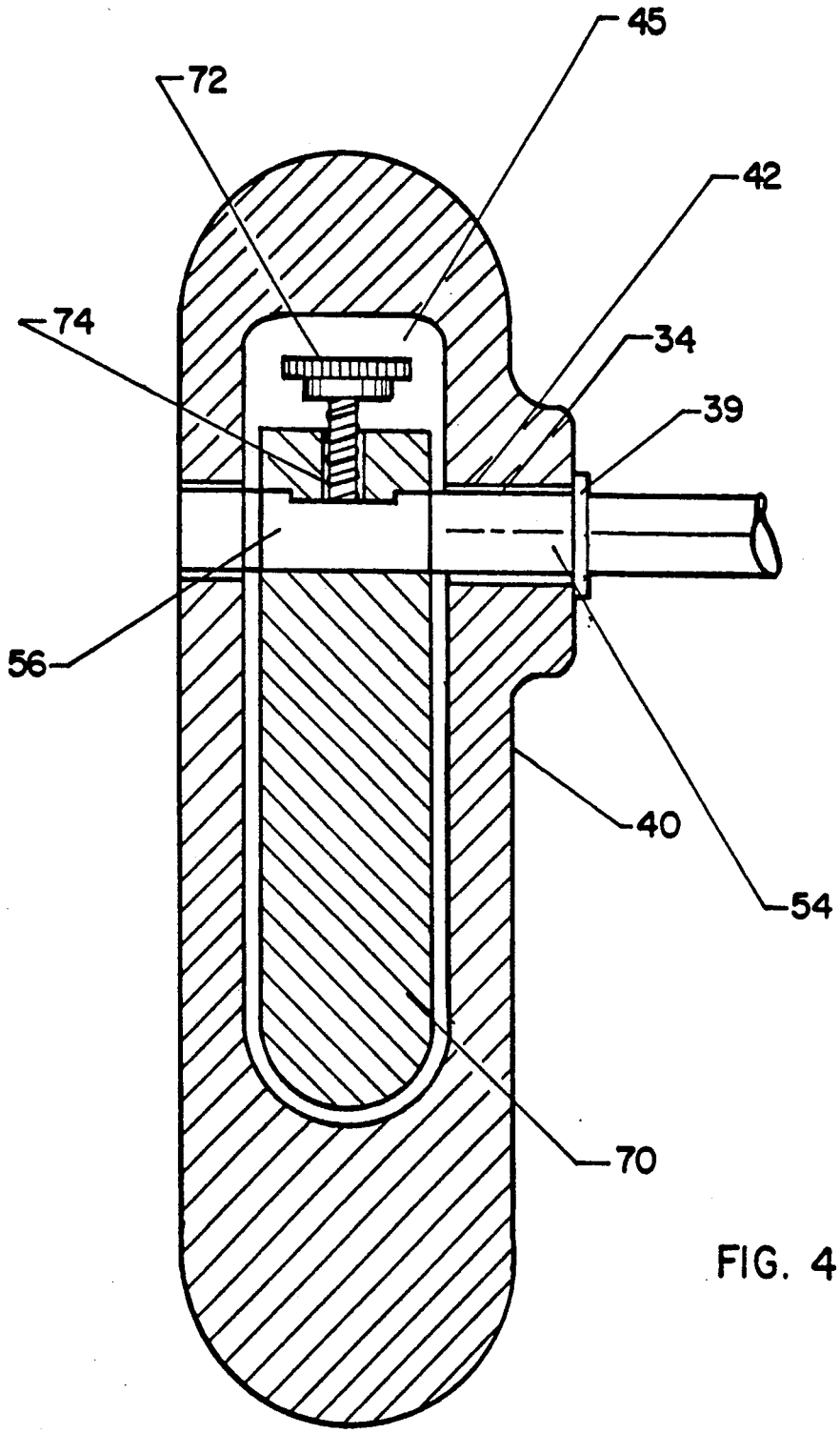
FIG. 4 is a cross-sectional view of the first handle and a second handle for the wrench of the present invention.

Referring to FIG. 4, the first handle 40 resembles an O-shaped configuration with an aperture 45. The aperture 45 is in direct communication with the interior 34 of the sleeve. The bore 42 of the first handle is located at the upper end of the first handle and as a result is offset from the transverse axis of the first handle. This offset enables a user to grasp the first handle in a pistol-like manner and thereby facilitates maneuverability of the wrench.

Figure 5A:
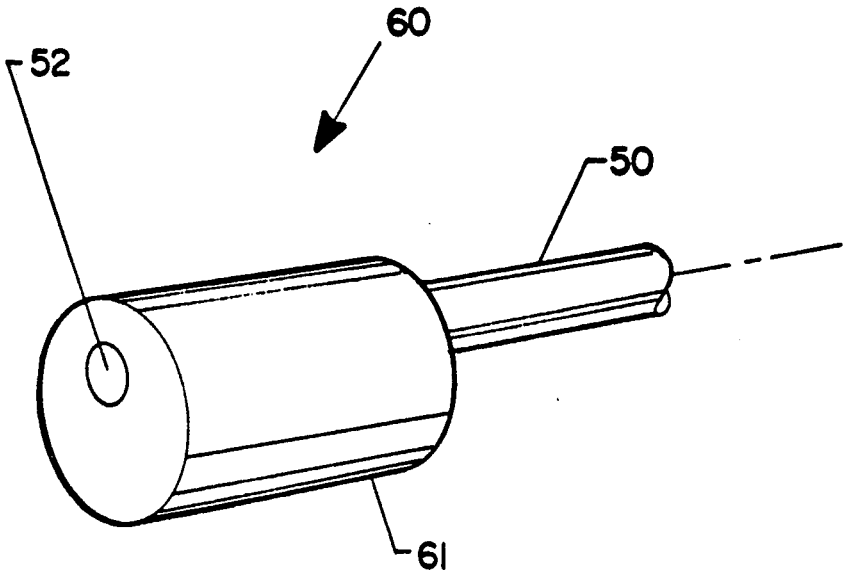
FIG. 5A is a perspective view of a cam for the present invention.
Figure 5B:
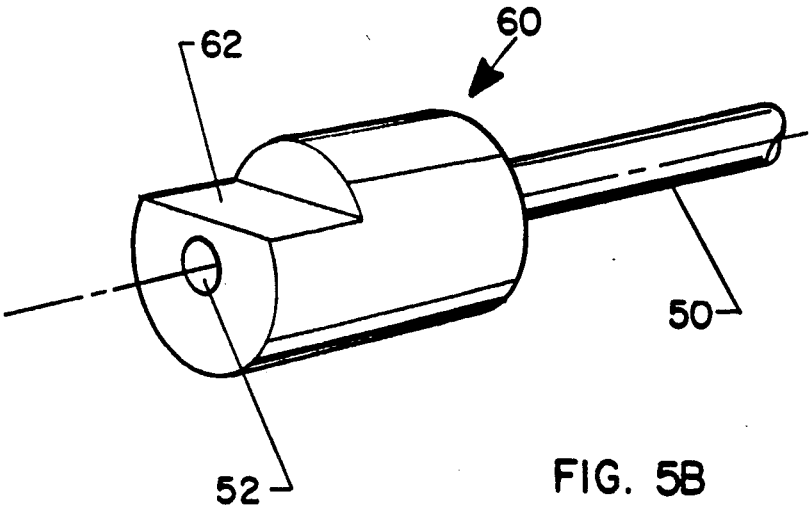
FIG. 5B is a perspective view of an alternative cam for the present invention.

Again referring to FIG. 1, the shaft 50 is rotatably disposed within the interior of the sleeve 30. A first end 52 of the shaft extends beyond the outer edge of the hub 22 and connects to the cam 60. The cam 60 accordingly rotates near the hub 22 of the grip. As shown in FIG. 5A, the cam 60 is eccentrically connected to the first end 52 of the shaft 50 and has cylindrical shape 61. Alternatively, the cam 60 has an approximately cylindrical shape with a flat surface 62, as seen in FIG. 5B, on the side opposite its side of contact with the electrical connector. The flat surface 62 increases the clearance of the wrench from adjacent connectors as the wrench is being rotated axially.

Referring to FIG. 4, a second end 54 of the shaft extends into the aperture 45 of the first handle and connects to the second handle 70. The second handle is located within the aperture 45 of the first handle and, preferably, has a block-like shape with solid construction. The second handle also has a locking screw 72 which passes through a tap 74. The locking screw bears down on a flat surface 56 of the shaft and secures the shaft to prevent rotation between the shaft and the second handle.

As demonstrated in FIG. 1, the second handle 70 may rotate in either direction about the axis of the shaft in a plane transverse to the first handle 40 and preferably in a plane at a right angle to the axis of the shaft 50. Rotation of the second handle 70 correspondingly causes rotation of the cam 60. If desired, a coil spring can be interposed between and interconnected to the sleeve 30 and the shaft 50 in such a fashion as to bias and urge the second handle into a position as represented in FIG. 1.

Figure 6:
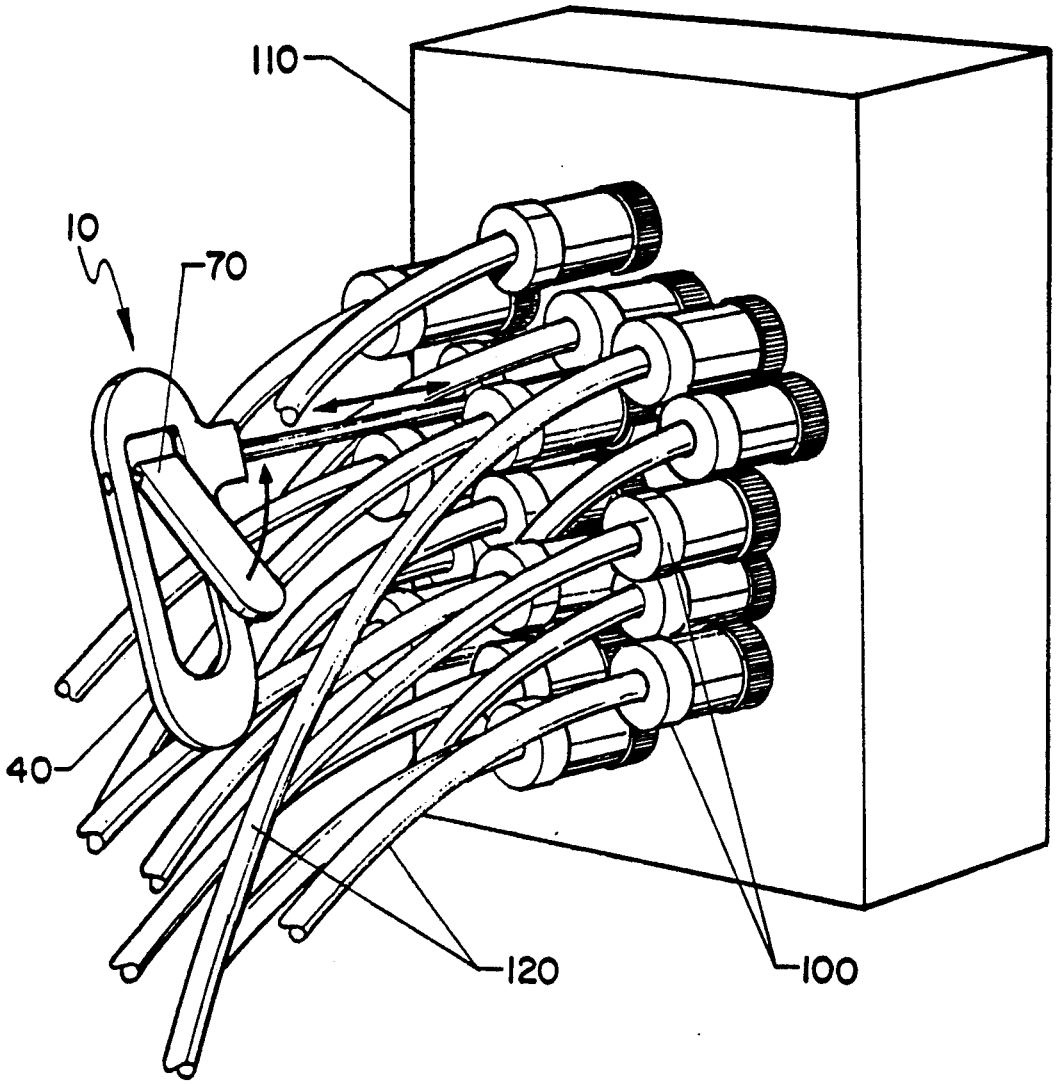
FIG. 6 is a perspective view of the wrench of the present invention combined with a representative view of an electric terminal assembly.

The wrench 10 of the present invention is intended primarily for installation or removal of an electrical terminal assembly. FIG. 6 illustrates a terminal assembly 110 having an array of clustered cable sections 120, each with an electrical connector 100 having a collar. These electrical connectors are designed for hand installation, however close spacing between the cable sections does not allow enough space for installing or removing by hand any electrical connector located within the interior of a clustered group of connectors. If an inner connector must be removed or installed, the surrounding connectors must be removed first. This entire procedure is time-consuming and may result in circuit continuity problems caused by excessive removal and re-installation.

The wrench of the present invention obviates this time-consuming process. First, the semicircular opening of the wrench has a lateral extent which is greater than the diameter of the collar of the electrical connector. This semicircular-shaped opening enables the user simply to grasp the first handle 40 and maneuver the wrench among the clustered cable sections 120 from a remote location outside of the clustered group until the grip is adjacent to the selected electrical connector 100. The grip is then moved laterally onto and thereafter engages the collar of the electrical connector. The specially-shaped claw thus avoids the need of inserting the grip over a cable and then advancing the grip along the path of the cable. As a result, the present wrench has enhanced maneuverability and may be used for connectors with oversized aft sections.

Once the wrench is in its initial engaging position as shown in FIG. 6, the user rotates the second handle 70 to rotate the cam until the cam engages the collar of the connector and forces the collar into a tight engagement with the claw. While holding the cam in a gripping engagement with the collar, the user may either rotate the wrench about the axis of the sleeve or translate the wrench axially to assemble or disassemble the connector from its associated plug to the terminal assembly. An inner connector is thus removed without removing other connectors.

The unique features of this invention include a semicircular-shaped claw for the gripping end of the wrench and a sliding attachment of the sleeve to the handle and to the grip. The advantages of the present invention are the ability to maneuver the wrench easily about a cluster of tightly-spaced cable sections of a terminal assembly, the ability to engage the electrical connector by sliding onto the connector from the side, and the ability to disassemble and to interchange the grip, the sleeve, and the handle with other grip sizes and sleeve lengths so as to manipulate a wide range of different-sized electrical connectors.

Although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the U.S. is:

1. A wrench for installing or removing an electrical connector having a collar comprising:

a sleeve having two ends;

means for receiving and holding the collar of the electrical connector, said means for receiving and holding attached to a first end of said sleeve, said means for receiving and holding having a hub and a claw, the claw defining a semicircular-shaped opening;

means for handling and maneuvering the wrench, said means for handling and maneuvering attached to a second end of said sleeve, said means for handling and maneuvering having an aperture in direct open communication with the interior of said sleeve;

a shaft having two ends, said shaft being rotatably mounted in the interior of said sleeve, the first end of said shaft extending beyond the outer end of the hub of said means for receiving and holding, the second end of said shaft extending into the aperture of said means for handling and maneuvering;

a cam, eccentrically connected to the first end of said shaft, positioned near the hub of said means for receiving and holding, for grippingly engaging a portion of the collar, said cam having a flat surface on the side opposite the side of contact with the collar; and means, inserted in the aperture of said means for handling and maneuvering, connected to the second end of said shaft, for rotating said shaft in either direction about the axis of said shaft, said rotation enabling said cam to rotate and combine with said means for receiving and holding so as to provide a gripping engagement of the collar.

* * * * *